United States Patent [19]

Krause

[11] Patent Number: 4,567,657

[45] Date of Patent: Feb. 4, 1986

[54] STRING TRIMMER TUBE CLAMPING

[75] Inventor: Richard T. Krause, Charlotte, N.C.

[73] Assignee: Textron Inc., Providence, R.I.

[21] Appl. No.: 539,167

[22] Filed: Oct. 5, 1983

[51] Int. Cl.[4] ..... B26B 7/00

[52] U.S. Cl. ..... 30/276; 403/292; 403/297; 464/52

[58] Field of Search ..... 30/276, 500; 56/12.7, 56/17.5; 464/52, 182, 183; 403/292, 297

[56] References Cited

U.S. PATENT DOCUMENTS

| | | | |
|---|---|---|---|
| 2,952,484 | 9/1960 | Zoltok | 403/297 |
| 4,126,928 | 11/1978 | Hoff | 464/52 |
| 4,148,141 | 4/1979 | Hoff | 30/276 |
| 4,188,719 | 2/1980 | Hoff | 30/122 |
| 4,226,021 | 10/1980 | Hoff | 30/276 |
| 4,286,675 | 9/1981 | Tuggle | 173/163 |
| 4,300,336 | 11/1981 | Miyata | 56/295 |
| 4,431,483 | 6/1984 | Johnson et al. | 464/52 X |

*Primary Examiner*—Douglas D. Watts

*Attorney, Agent, or Firm*—Cushman, Darby & Cushman

[57] ABSTRACT

Clamping is provided for a drive shaft tube to a housing that uniformly distributes the clamping forces, eliminating high concentrations of clamping pressure, and accomplishing clamping in an aesthetic manner. A one-piece tubular housing, having an inner surface, for the trimmer head includes a drive shaft component within it. A tubular casing containing a flexible drive shaft has an outer surface for receipt by, and engagement with, the trimmer housing inner surface. A pair of clamping components having an arcuate extent generally comparable to the circumference of the tubular casing inner surface engage the inner surface, and clamp the tubular casing to the trimmer housing inner surface by the action of a pair of screw fasteners having heads exterior of the first housing, and threaded shanks extending into threaded engagement with openings in the inner clamping components.

20 Claims, 10 Drawing Figures

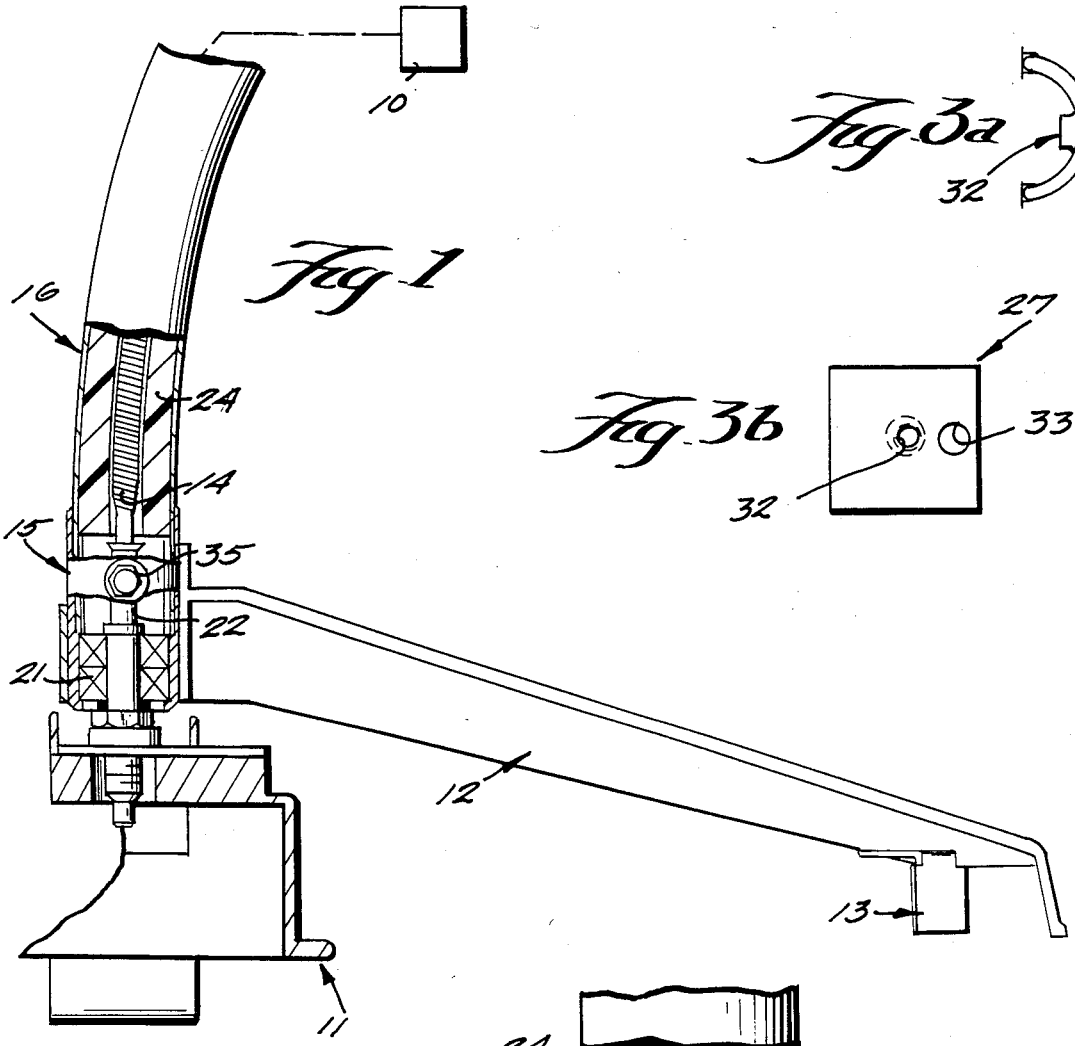
Fig. 1
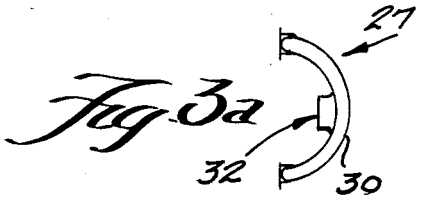
Fig. 3a
Fig. 3b
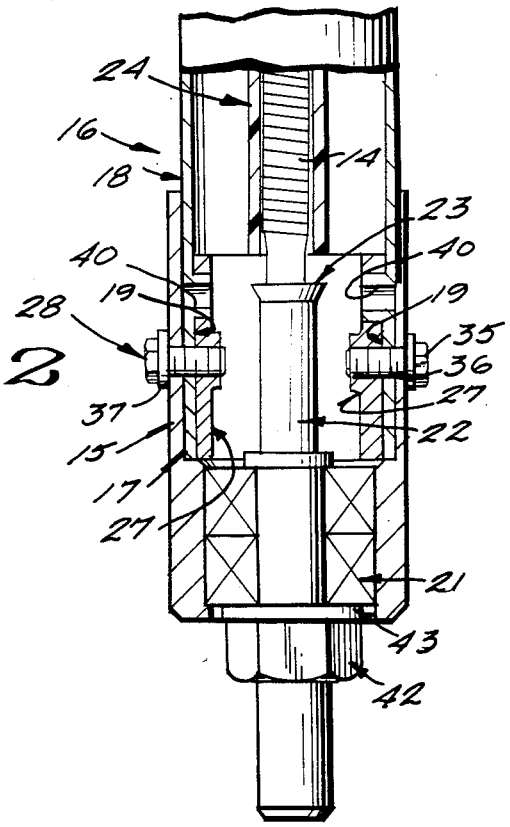
Fig. 2

Fig. 4
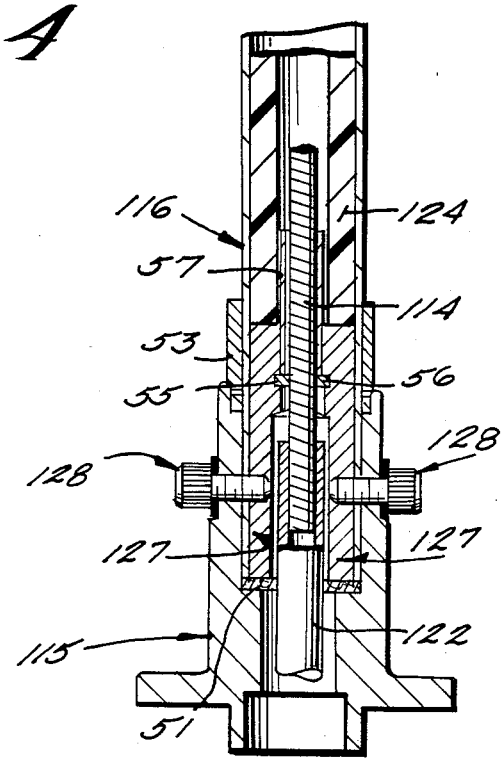
Fig. 6
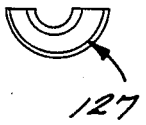
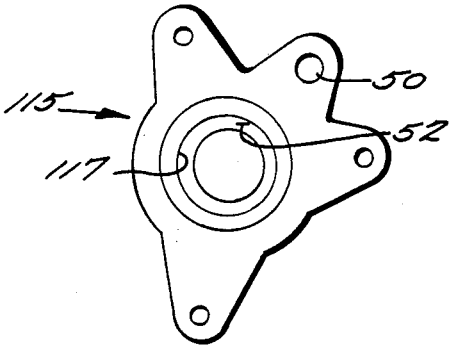
Fig. 5

Fig. 7
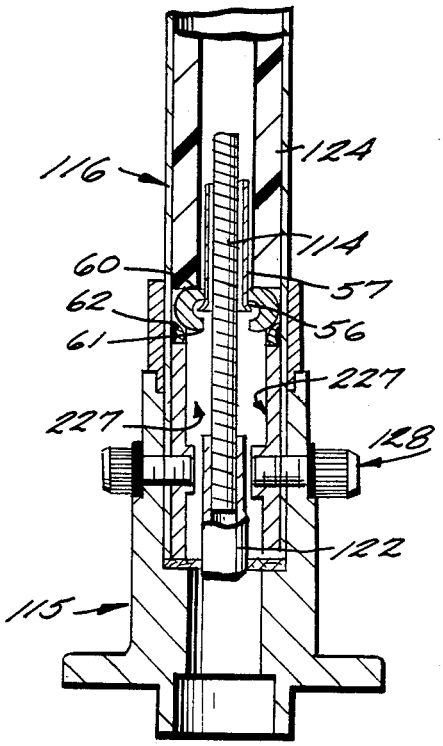
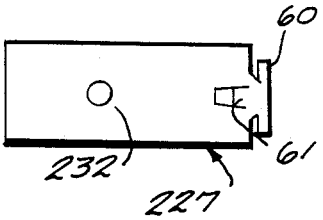
Fig. 8b
Fig. 8a
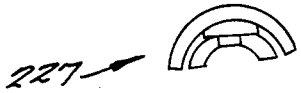

STRING TRIMMER TUBE CLAMPING

BACKGROUND AND SUMMARY OF THE INVENTION

In a number of power tools, particularly gasoline powered string trimmers or brush cutters, with a power unit at the handle portion of the tool and a working implement remote from the power head, a mechanism must be provided for properly transmitting power from the power head to the working implement. This is accomplished utilizing a drive shaft tube which contains a flexible shaft, the flexible shaft interconnecting a drive shaft portion from the power head, and a drive shaft portion from the working implement. Conventional mechanisms for clamping the drive shaft tube to a trimmer head (the power head or working implement head) have been relatively expensive and have had less than desired durability.

A typical manner of attaching the drive tube to the power head or working implement head is an external clamp, such as a conventional hose clamp. Another common alternative is to form the power head or working implement head as a split housing, with one or more screws deforming the housing and clamping the tube. The split housing arrangement can result in high force concentrations, which may result in fracturing of the tube, especially when it is thin-walled. A split housing arrangement is also relatively expensive, and the hose clamp arrangement does not have the desired durability or aesthetic appeal.

According to the present invention, a clamping mechanism is provided for clamping two tubular components together, which clamping mechanism is particularly adapted for use with string trimmers or brush cutters, or like power tools. The clamping mechanism according to the present invention is relatively inexpensive, yet is very durable, providing uniform clamping pressure over substantially the entire length of the clamp at the points of contact between the clamp, drive tube, and housing, so that undesired force concentrations are avoided. Also, the clamping mechanism according to the present invention has good aesthetic appeal.

According to one aspect of the present invention, there is provided a string trimmer comprising: A power source. A trimmer head including a first one-piece tubular housing portion having an inner surface. A flexible shaft for operatively interconnecting said power source and said trimmer head. A second tubular housing portion containing said flexible shaft therewithin, said second tubular housing portion having an outer surface of generally the same cross-sectional shape and area as said first housing portion inner surface, and having an inner surface; and means for clamping said first and second housing portions together so that the outer surface of said second housing portion engages the inner surface of said first housing portion, while said first and second shaft portions are in operative association with each other. The clamping means comprise: A plurality of inner clamping components, each having an outer surface having a circumferential extent less than the circumferential extent of the inner surface of said second housing portion, and said inner clamping component outer surfaces collectively having a circumferential extent substantially equal to the circumferential extent of said second tube inner surface; and a plurality of outer clamping components cooperating with said first housing and said inner clamping components to provide a clamping force holding said second housing outer surface into clamping engagement with said first housing inner surface with a generally uniform clamping force over the area of interengagement between said first housing inner surface and second housing outer surface.

While for clarity of presentation the invention is described with reference to a gasoline powered string trimmer, or the like, it is to be understood that the clamping mechanism according to the invention is also utilizable with a wide variety of other power tools, or in other environments where uniform clamping pressure between concentric tubular portions is desirable. It is the primary object of the present invention to provide a clamping mechanism for clamping concentric tubular portions together with a uniform clamping force. This and other objects of the invention will become clear from an inspection of the detailed description of the invention, and from the appended claims.

BRIEF DESCRIPTION OF THE DRAWINGS

FIG. 1 is a side view, partly in cross-section and partly in elevation, of a string trimmer utilizing the clamping mechanism according to the present invention;

FIG. 2 is a detail cross-sectional view of the clamping mechanism utilized in the structure of FIG. 1;

FIGS. 3*a* and 3*b* are top and end views, respectively, of one of the inner clamping components of the clamping mechanism of FIG. 2;

FIG. 4 is a cross-sectional view like that of FIG. 2 only showing another exemplary embodiment of clamping components according to the present invention;

FIG. 5 is a top plan view of the first tubular housing portion of the mechanism of FIG. 4;

FIG. 6 is a bottom plan view of one of the inner clamping components of the mechanism of FIG. 4;

FIG. 7 is a side cross-sectional view like that of FIGS. 2 and 4 only showing another exemplary embodiment of a clamping mechanism according to the present invention; and FGIS. 8*a* and 8*b* are top and end views respectively of an inner clamping component of the embodiment of FIG. 7.

DETAILED DESCRIPTION OF THE DRAWINGS

FIG. 1 illustrates a conventional power head 10 for a string trimmer, brush cutter, or the like, which is interconnected to a working implement head 11 having a deflector 12 and cutting blade 13 by a flexible drive shaft 14. The head 11 includes a first tubular housing portion 15, which is adapted to be connected to a second, thin-walled, tubular housing portion (drive tube) 16 which contains the flexible drive shaft 14. The first tubular housing portion 15 includes an inner surface 17 (see FIG. 2) which preferably is circular in cross-section. The second tubular housing portion 16 includes an outer surface 18 which has substantially the same cross-sectional configuration and dimensions as the surface 17, and is adapted to be received within the first tubular housing 15 and to abut the surface 17. The second tubular housing portion 16 also includes an inner surface 19. The inner surface 19 also is preferably circular in cross-section.

The first tubular housing 15 is adapted to receive bearing means 21 therein, and includes a drive shaft portion 22 having an end 23 thereof adapted to receive an end of the flexible shaft 14. A locating plug or insert 24, which preferably is constructed of a plastic, centers the flexible shaft 14 within the second tubular housing 16. The shaft 14 and the drive shaft portion 23 are operatively connected so that rotation of the flexible shaft 14 under the influence of the power head 10 is transmitted into rotation of the drive shaft portion 22, and thus the trimmer head 11, or other working implement.

The clamping means according to the present invention provide for clamping of the outer surface 18 of the second tube 16 to the inner surface 17 of the first tube 15 in a manner such that uniform clamping pressure is provided in a simple and inexpensive manner. In the exemplary embodiment of the clamping means illustrated in FIGS. 1–3*b*, the clamping means comprises a plurality of inner clamping components 27, and a plurality of outer clamping components 28. In the exemplary embodiment illustrated, two inner clamping components 27 and two outer clamping components 28 are illustrated, but it is to be understood that the number and ratio of such components can be varied depending upon the construction, dimensions, and use-environment of the tubes clamped together thereby.

A typical inner clamping component 27 according to the invention is illustrated most clearly in FIGS. 3*a* and 3*b*. The inner clamping component 27 comprises a simple, inexpensive metal stamping having an outer surface 30 adapted to engage the inner surface 19 of the second tubular housing 16. Where the surface 19 is circular in cross-section, the surface 30 will be arcuate, having the same radius as the surface 19. The components 27 are constructed and dimensioned so that collectively the circumference of the outer surfaces 30 thereof is substantially equal to the circumference of the surface 19. For the specific case illustrated in the drawings wherein two inner components 27 are utilized, they are essentially in the form of half a tube, the arcuate extent of the surface 30 being slightly less than 180°.

Each component 27 has a first, radially extending, internally threaded bore 32 therein, and a second, radially extending, preferably unthreaded, bore 33. The threaded bore 32 may be replaced by conventional threaded nuts, or clench nuts, if desired.

The inner clamping components 27 are preferably constructed so that they are all substantially identical (i.e. no left hand and right hand components are necessary), as are the fasteners 28.

The outer clamping components 28 preferably each comprise a fastener including a head 35 and an externally threaded shank 36. Preferably the shank 36 passes through aligned un-threaded radially extending bores (unnumbered) in the tubular housing portions 15, 16 and cooperates with the internal threads of the bore 32 of an associated inner clamping component 27. The head 35 operatively engages an outer surface of the first housing portion 15, as through a conventional washer 37, so that the inner clamping component 27 is drawn up tight against the surface 19, and the head 35 and the inner component 27 provide a clamping force holding the tube 16 in the tube 15 with uniform force concentration.

In order to positively locate the inner clamping components 27 with respect to the second tubular housing 16, it is preferable to deform portions of the housing 16 into operative engagement with the surface defining each of the bores 33. This can be seen in FIG. 2, wherein the housing 16 portions 40 have been deformed into operative association with the bores 33 of the two inner clamping components.

An exemplary of assembly of the structure illustrated in FIG. 1 is as follows:

The bearing means 21 is pressed into the housing 15, and the drive shaft portion 22 is installed therein utilizing nut and washer 42, 43, respectively, and torquing them down. The inner clamping components 27 are then placed into contact with the inner surface 19 of the housing 16, with the bores 32 aligned with corresponding bores (unnumbered) in the housing 16. Then portions 40 of the housing 16 are deformed (e.g. extruded) so that they engage the inner surfaces defining the bores 33, and thereby hold the inner clamping components 27 in an appropriate position within the housing 16. Then the open end of first tubular housing 15 is slid over the second tubular housing 16 so that the surfaces 18, 17 engage, and the radial bores (unnumbered) therein are aligned. Then the fasteners 28 are threaded through the bores and so that their shanks 36 cooperate with the interior threads of the bores 32, and the fasteners 28 are tightened down.

In the embodiment illustrated in FIGS. 4 through 6, components comparable to those in the FIGS. 1 through 3*b* embodiment are shown by the same reference numeral only preceded by a "1".

In the embodiment illustrated in FIGS. 4 through 6, the first housing 115 includes a number of lobes 50 which may be attached to another housing component, deflector, or the like. A felt washer 51, or the like, is provided between the inner clamping components 127 and a ledge 52 of the housing 115. A cover 53 is disposed at the top of the housing 115, surrounding the second tubular housing 116.

The major distinction between the FIGS. 4 through 6 embodiment and the FIGS. 1–3*b* embodiment is in the construction of the inner clamping components 127. In this embodiment, the inner clamping components 127 each have an arcuate groove 55 formed on an inner surface thereof. The groove 55 is adapted to cooperate with a flange 56 extending from a casing 57 surrounding the flexible shaft 114. The groove 55 and flange 56 cooperate to hold the clamping components 127 to the tubular housing 116 in much the same manner that the bores 33 and deformed portions 40 cooperate to hold the components together in the FIGS. 1–3*b* embodiment.

The FIGS. 7–8*b* embodiment is identical to the FIGS. 4–6 embodiment except for the particular nature of the inner clamping components. The structures in the FIGS. 7–8*b* embodiment are illustrated by the same reference numerals as the corresponding structures in the FIGS. 4–6 embodiment, and the inner clamping components are referred to generally by reference numerals 227.

The inner clamping components 227 include a threaded radially extending bore 232 for cooperating with the fasteners 128, and include deformed end surfaces 60, 61 which are adapted to receive the flange 56 from the casing 57. To locate the inner clamping components 227 with respect to the second housing 116, portions 62 of housing 116 are deformed to engage member 61.

While the invention has been described with particular reference to the head housing 15, 115 receiving the drive shaft tube 16, 116 therewithin, in other embodiments utilizing the clamping mechanism according to the invention these components may be reversed.

It will thus be seen that according to the present invention a simple, inexpensive, effective, and aesthetic clamping mechanism has been provided for interconnecting two tubular portions, particularly a string trimmer head tubular housing portion and a drive tube, and apply substantially uniform clamping force. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. In a power tool a combination comprising: a generally tubular integral first housing portion having an inner surface; a first shaft portion disposed in said first housing portion; a second generally tubular integral housing portion having an outer surface and an inner surface, said outer surface of said second housing portion having generally the same cross-sectional shape and area as said first housing portion inner surface; a second shaft portion disposed in said second housing portion; means for clamping said first and second housing portions together so that the outer surface of said second housing portion engages the inner surface of said first housing portion, while said first and second shaft portions are in operative association with each other, said clamping means comprising:

a plurality of inner clamping components, each having an outer surface having a circumferential extent less than the circumferential extent of the inner surface of said second housing portion, and said inner clamping component outer surfaces collectively having a circumferential extent substantially equal to the circumferential extent of said second tube housing portion inner surface; and a plurality of circumferentially spaced outer clamping components cooperating with said first housing and said inner clamping components to provide a clamping force holding said second housing outer surface into clamping engagement with said first housing inner surface with a generally uniform clamping force over the area of interengagement between said first housing inner surface and second housing outer surface.

2. A combination as recited in claim 1 wherein said first shaft portion comprises a drive shaft for driving a powered implement, and wherein said second shaft portion comprises a power transmitting shaft for transmitting power from a source to said drive shaft.

3. A combination as recited in claim 2 wherein said power transmitting shaft is a flexible shaft, and wherein said powered implement is a string trimmer.

4. A combination as recited in claim 1 wherein said inner surface of said first housing, said outer surface of said second housing, and said inner surface of said second housing are circular in cross-section; and wherein said inner clamping component outer surfaces have an arcuate extent conforming to the circular-cross-section inner surface of said second housing.

5. A combination as recited in claim 4 wherein said inner clamping components are substantially identical.

6. A combination as recited in claim 5 wherein said inner clamping components consist of two components.

7. A combination as recited in claim 6 wherein each of said inner clamping components comprises approximately half of a tube.

8. A combination as recited in claim 7 wherein said outer components consist of a pair of fasteners each having a threaded shank portion and a head at one end thereof, and wherein said first and second housings each have a pair of radially through-extending bores therein, and wherein each of said inner clamping components include a threaded radially extending bore therein; said threaded shank of each of said fasteners passing through said housing bores and into threaded engagement with said inner clamping component threaded portion, with said fastener head engaging an outer portion of said first housing.

9. A combination as recited in claim 1 wherein said outer components consist of a plurality of fasteners each having a threaded shank portion and a head at one end thereof, and wherein said first and second housings each have a plurality of aligned radially through-extending bores therein corresponding in number to said outer clamping components, and wherein each of said inner clamping components include a threaded radially extending bore therein; said threaded shank of each of said fasteners passing through said housing bores and into threaded engagement with said inner clamping component threaded portion, with said fastener head engaging an outer portion of said first housing.

10. A combination as recited in claim 9 wherein each of said inner clamping components includes a radially extending bore axially spaced from said threaded bore, and wherein said second housing includes a portion thereof deformed into said second bore of each of said inner clamping components.

11. A combination as recited in claim 1 wherein said second shaft portion includes a casing surrounding it, said casing spaced from said second housing portion and contained therewithin; said casing including a radially extending flange portion thereof; and said inner clamping components including locating surface manifestations for cooperating with said casing flange to locate the position of said casing with respect to said clamping components.

12. A combination as recited in claim 1 wherein each of said inner clamping components contains a radially extending bore therein; and wherein said second housing has a portion thereof deformed into each of said bores, engaging the interior surfaces of said bores, to positively locate said second housing with respect to said inner clamping components.

13. A string trimmer comprising: a power source; a trimmer head including a first one piece tubular housing portion having an inner surface; a flexible shaft for operatively interconnecting said power source and said trimmer head; a second tubular housing portion containing said flexible shaft therewithin, said second tubular housing portion having an outer surface of generally the same cross-sectional shape and area as said first housing portion inner surface, and having an inner surface; and means for clamping said first and second housing portions together so that the outer surface of said second housing portion engages the inner surface of said first housing portion, while said first and second shaft portions are in operative association with each other, said clamping means comprising:

a plurality of inner clamping components, each having an outer surface having a circumferential extent less than the circumferential extent of the inner surface of said second housing portion, and said inner clamping component outer surfaces collectively having a circumferential extent substantially equal to the circumferential extent of said second tube inner surface; and a plurality of circumferentially spaced outer clamping components cooperating with said first housing and said inner clamping components to provide a clamping force holding said second housing outer surface into clamping engagement with said first housing inner surface with a generally uniform clamping force over the area of interengagement between said first housing inner surface and second housing outer surface.

14. A combination as recited in claim 13 wherein said inner surface of said first housing, said outer surface of said second housing, and said inner surface of said second housing are circular in cross-section, and wherein said inner clamping component outer surfaces have an arcuate extent conforming to the circular-cross-section inner surface of said second housing; and wherein said inner clamping components consist of two components.

15. A combination as recited in claim 13 wherein said outer components consist of a plurality of fasteners each having a threaded shank portion and a head at one end thereof, and wherein said first and second housings each have a plurality of aligned radially through-extending bores therein corresponding in number to said outer clamping components, and wherein each of said inner clamping components include a threaded radially extending bore therein; said threaded shank of each of said fasteners passing through said housing bores and into threaded engagement with said inner clamping component threaded portion, with said fastener head engaging an outer portion of said first housing.

16. A combination as recited in claim 13 wherein each of said inner clamping components contains a radially extending bore therein; and wherein said second housing has a portion thereof deformed into each of said bores, engaging the interior surface of said bores, to positively locate said second housing with respect to said inner clamping components.

17. Apparatus comprising:

a one piece first tube having an inner surface with a circular cross-section;

a thin walled second tube having inner and outer surfaces of circular cross-section, said outer surface having a circumference substantially the same as the circumference of said first tube inner surface;

a plurality of inner clamping components, each inner clamping component having an outer arcuate surface corresponding to a portion of the inner surface of said second tube, and said outer surfaces of said clamp components collectively having a circumference approximating the circumference of said second tube inner surface;

a threaded radially extending opening in each of said inner clamping components; a radially extending bore in said first tube in alignment with each of said threaded radially extending bores in said inner clamping component;

a fastener having a head and a threaded shank associated with each of said inner clamping components, said threaded shank passing through a bore in said first tube and engaging said threaded bore in a cooperating clamping component, with said fastener head operatively engaging an exterior portion of said first tube.

18. A combination as recited in claim 17 wherein said inner clamping components consist of two components.

19. A combination as recited in claim 18 wherein each of said inner clamping components comprises approximately half of a tube.

20. A combination as recited in claim 17 wherein each of said inner clamping components contains a radially extending bore therein; and wherein said second housing has a portion thereof deformed into each of said bores, engaging the interior surface of said bores, to positively locate said second housing with respect to said inner clamping components.

* * * * *